US006481401B1

(12) United States Patent
Schäfer

(10) Patent No.: US 6,481,401 B1
(45) Date of Patent: Nov. 19, 2002

(54) DEVICE FOR INDEPENDENT HYDRAULIC ACTUATION OF THE PHASE AND AXIAL POSITION OF A CAMSHAFT

(75) Inventor: Jens Schäfer, Herzogenaurach (DE)

(73) Assignee: Ina Walzlager Schaeffler Ohg, Herzogenaurach (DE)

( * ) Notice: Subject to any disclaimer, the term of this patent is extended or adjusted under 35 U.S.C. 154(b) by 0 days.

(21) Appl. No.: 09/839,792

(22) Filed: Apr. 20, 2001

(30) Foreign Application Priority Data

Apr. 22, 2000 (DE) ..... 100 20 119

(51) Int. Cl.[7] ..... F01L 1/34

(52) U.S. Cl. ..... 123/90.17; 123/90.18; 123/90.12; 74/568 R

(58) Field of Search ..... 123/90.12, 90.15, 123/90.17, 90.18, 90.31; 74/568 R; 464/1, 2, 160

(56) References Cited

U.S. PATENT DOCUMENTS 4,091,776 A * 5/1978 Clemens ..... 123/90.15
6,170,448 B1 * 1/2001 Asakura ..... 123/90.18
6,244,230 B1 * 6/2001 Mikame ..... 123/90.17

FOREIGN PATENT DOCUMENTS

DE 19842431 A1 3/1999
JP 355069715 * 5/1980 ..... 123/90.18

* cited by examiner

*Primary Examiner*—Thomas Denion
*Assistant Examiner*—Jaime Corrigan
(74) *Attorney, Agent, or Firm*—Volpe and Koenig, P.C.

(57) ABSTRACT

A device for independent hydraulic actuation of phase and axial positions of a camshaft of an internal combustion engine with a phase adjuster and an actuating piston arranged on a common axis for axial displacement of the camshaft. In order to reduce the space needed and construction expenditure of the device, the phase adjuster also acts as the actuating piston for the camshaft.

9 Claims, 3 Drawing Sheets

DEVICE FOR INDEPENDENT HYDRAULIC ACTUATION OF THE PHASE AND AXIAL POSITION OF A CAMSHAFT

BACKGROUND

The invention concerns a device for independent actuation of the phase and axial position of a camshaft.

Otto motors usually operate with a load-dependent change of the fuel-air mixture. This is, as a rule, varied by a throttling device, for example by a throttle valve. This leads to throttling losses during load changes. The throttling losses can be diminished by variation of the aperture cross section of the intake valves, for example by changing its stroke. For this, for example, an axially moveable intake camshaft with a conical or three-dimensional cam contour is suitable.

A strong charging movement is also advantageous with a partial load as it can be triggered by a retarded beginning of suction. The high rate of combustion caused by this also brings about, even with retarded beginning of suction, a punctual end of combustion. A retarded beginning of combustion with a punctual end of combustion however brings about a low peak pressure, a slight tendency to knock and low nitrogen oxide formation without several combustion disadvantages. The shifting of opening and closing times of the intake and if need be the exhaust valves required for this can be realized by known phase adjusters arranged in the power train between crankshaft and camshaft. Variable valve cross sections and control times are accordingly advantageous for an economical and environmentally friendly operation of the Otto motor.

From DE 199 02 095 A, a device for independent hydraulic actuation of the phase and axial position of a camshaft is known. For reasons of construction space, the phase adjuster is arranged on the directly driven exhaust camshaft. Its output element is connected with a gear which is mounted on the exhaust camshaft and which drives the gear of the intake camshaft. The motor-attached stroke actuator is connected with this through a slide gearing. The slide gearing must be provided with minimal backlash as this is a source of disturbing noises. The same applies for the tooth wheel drive between the two camshafts. For this reason, with this solution, an expensive compensation for or restriction of the torsional backlash is provided.

From DE 199 03 622 A1, a device for independent hydraulic actuation of the phase and axial position of a shaft, especially the intake camshaft of an internal combustion engine, is known, with a phase adjuster constructed as rotatble piston actuator, which has a stator and a rotor, and with an actuating piston arranged in the same axis for axial movement of the intake camshaft. In addition, this device has a cylindrical housing for the actuating piston whereby the housing is connected with the stator and a drive wheel and the rotor as well as the actuating piston are in a rotationally fixed connection with the intake camshaft.

Since the actuators are arranged one after the other, they require a considerable construction length. Since the phase adjuster is positioned axially stationary, they require, in relation to the axially movable camshaft, a sliding gearing with the known expensive measures for avoiding gear backlash.

Underlying the invention is the object of creating a generic device for independent hydraulic actuation of the phase and axial position of a camshaft whereby the device is distinguished by a small space requirement and low construction expenditure.

SUMMARY

In accordance with the invention, this object is accomplished by providing a device in which the phase adjuster also forms the actuating piston for the camshaft. Since the phase adjuster is at the same time the actuating piston of the camshaft, it moves along with the axial movement of the camshaft. In this way, the necessity of a slide gearing in addition to gear backlash compensation between phase adjuster and camshaft is dispensed with, which leads to a considerable simplification of the device. Dispensing with a separate actuation piston likewise diminishes construction expense and at the same time diminishes the overall length of the device.

A preferred embodiment of the invention is provided in that the phase adjuster is constructed as a segment vane actuator which has a cylindrical rotor, in the peripheral area of which at least one axial, concentric hydraulic chamber in the form of a oblong hole is provided. The hydraulic chamber is subdivided by a segment into two active oil chambers A and B with sealing play and is laterally closed off by two side covers with close play. Here the side covers have apertures aligning with the cross section shape of the segment through which the same extends with sealing play. Such a segment vane actuator is described in the not previously published German patent application P 199 51 390.2. It is distinguished by a small number of structural units and its economical producibility. While the segments described in the not previously published German patent application P 199 51 390.2 are inserted between the side covers, these extend, in the construction of the invention, through the aligning apertures of the side covers. These aligning apertures permit a lengthening of the segments over the width of the rotor so that these can serve as guide rods during axial motion of the segment vane actuator. The close play between the apertures and the segments moreover serve for lateral sealing of the active oil chambers A and B.

An advantageous refinement of the invention is provided in that the length of the segments exceeds the greatest width of the rotor at least by the stroke dimension of the camshaft, and in that the constructed hollow segments are clamped from rotating by means of bolts that extend through the same between a bottom of the housing and a cover plate preferably constructed as a drive wheel. The length of the segments selected permits the desired axial displacement of the segment vane actuator and the intake camshaft connected with it. The driving torque of the camshaft is transferred from the drive wheel through the segments inserted between this and the housing and the pressure oil in active oil chambers A and B to the rotor and the camshaft connected with it.

It is advantageous if the rotor has, on both sides, coaxial, cylindrical recesses for the side covers and that the side covers are axially fixed though retaining rings. Since the side covers, in the construction of the segment vane actuator of the invention, cannot be braced on one another, their close play in relation to the rotor is guaranteed through the exact axial position of the retaining rings sitting in the grooves of the same. The side walls moreover serve exclusively for lateral sealing of active oil chambers A and B and not for transfer of the driving torque of the segments.

An appropriate construction of the invention is provided in that on the periphery of the rotor, at least sealing element is arranged though which the cylindrical housing is subdivided into first and second operating chambers. Since the rotor is radially guided by the segments, it must have radial play in relation to the cylindrical housing which is bridged by the sealing element. The sealing element can be constructed as a sealing ring, sealing strip or piston guide way.

Due to the fact that first and second 4/3 way proportional valve are provided for independent hydraulic control of active oil chambers A and B and the first and second chambers, a motor-optimal control of the camshafts is made possible.

It is advantageous that a preferably decentralized control apparatus is provided for the proportional valves which receives signals on phase and stroke position of the camshaft from a camshaft sensor and such on, for example, motor speed, motor load and motor temperature from a central control apparatus of the internal combustion engine. The central control apparatus makes possible a flexible supplementation of the motor control apparatus which is not affected by possible changes of the camshaft.

Preferably a seal ring carrier of a rotary oil through passage device is located between rotor and intake camshaft, which has oil sealing rings for mutual and outward acting sealing of the radial grooves of oil supply channels. In this way, oil leakage losses of the rotary oil through passage with a relatively long overall length are minimized.

An advantageous refinement of the invention is provided in that the radial forces of the drive wheel are transmissible over the segments and the rotor or directly to the sealing ring carrier and the camshaft. The mounting of the drive wheel over the segments on the walls of the hydraulic chambers (the so-called internal mounting) offers the advantage of the smallest play possible between active oil chambers A and B with correspondingly low leakage. A precondition for this is a correspondingly wear and tear resistant surface of the walls of the hydraulic chambers. In contrast, with direct mounting of the driving wheel on the seal ring carrier (or so-called external mounting), owing to the bearing play there, a corresponding enlargement of the close play of the segments in the hydraulic chambers is necessary, which has increased oil leakage losses or the installation of additional sealing elements as a consequence. For this, the walls of the hydraulic chambers in this case require no protection against wear and tear, so that the rotor can be formed of light metal, for example, of aluminum, and be manufactured by the extrusion or cold forging method.

Due to the fact that the rotor has a locking element, preferably an axial fixing pin which is latchable in a blind aperture of one of the side covers, the starting position of the rotor is assured which among other things is important for a good motor start. Of course, the use of a radial fixation pin or a wedge locking device or the like is also conceivable.

Further features of the invention are provided in the patent claims, the following description and the drawings in which an embodiment of the invention is schematically represented.

BRIEF DESCRIPTION OF THE DRAWINGS

A preferred embodiment of the invention is explained in detail in connection with the drawings. In the drawings.

DETAILED DESCRIPTION OF THE PREFERRED EMBODIMENTS

Figure 1:
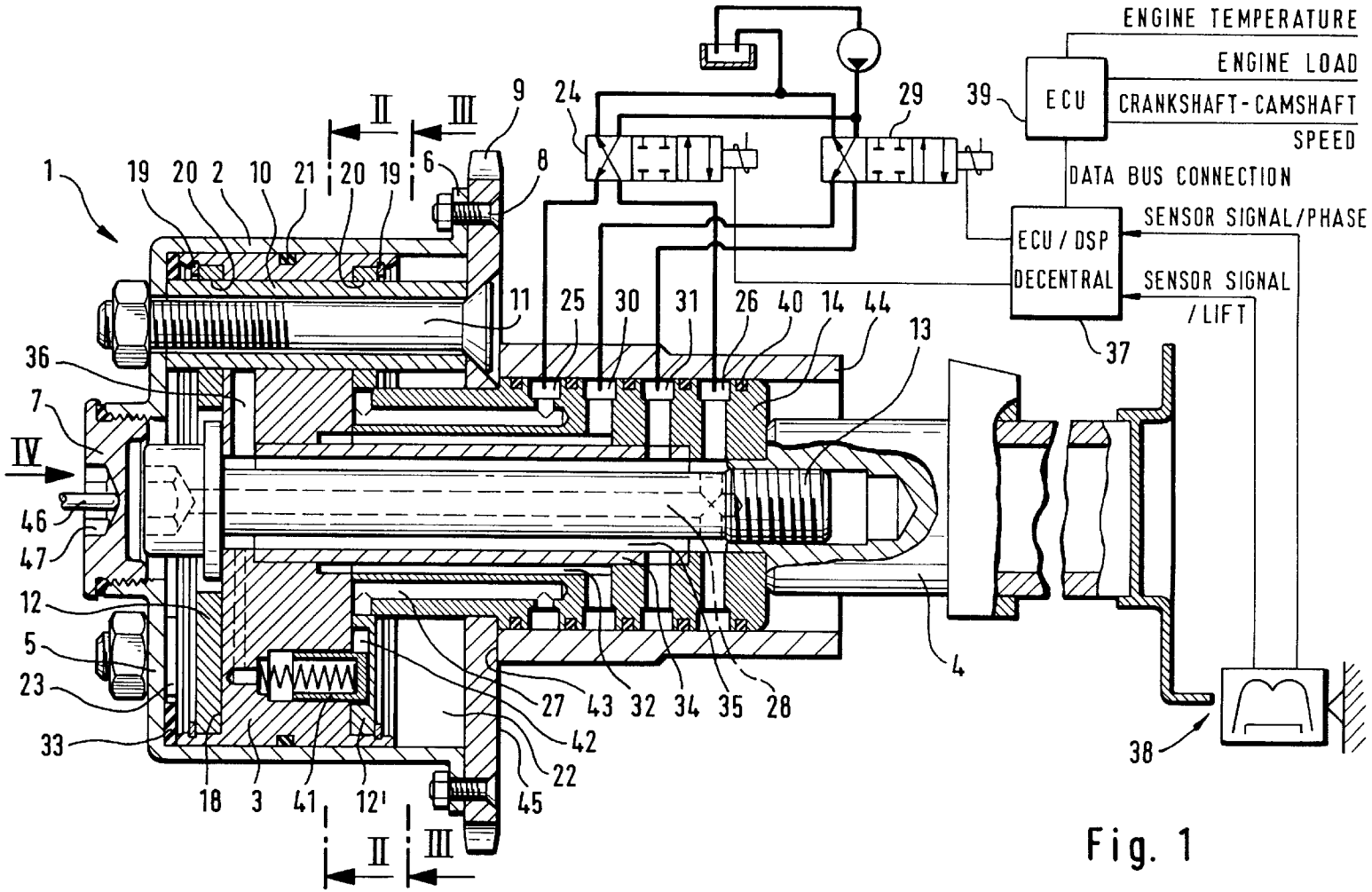
FIG. 1 is a longitudinal section view through the segment vane actuator along section plane A—A of FIG. 2.

The segment vane actuator 1 represented in FIG. 1 has a cylindrical housing 2 which is also constructed as an operating hydraulic cylinder for a cylindrical rotor 3 of the segment vane actuator. This serves as a phase adjuster for a camshaft 4 and at the same time as an actuating piston for axial displacement of the camshaft 4.

One end of the housing 2 is provided with a bottom 5, and a flange 6 is provided on its other end. Both are connected in one piece with the cylindrical part of the housing 2. The bottom 5 has a central assembly aperture with a screw cap 7. The flange 6 is joined rotatably fast by flange screws 8 with a cover plate constructed as drive wheel 9. The drive wheel 9 is driven through a chain (not shown) by a crankshaft (not shown).

The housing 2 is axially fixed on the camshaft side though the face 43 of a bearing bushing 44 affixed to the motor against which the outer surface 45 of the drive wheel 9 runs. On the opposite side, the housing 2 is axially fixed by a control space cover (not represented) affixed to the motor and a bearing pin 46 which engages in the hexagon 47 of the screw cap 7.

In the interior of the housing 2, five hollow constructed segments 10 are arranged. These are connected by through bolts 11 which extend through aligned holes in the drive wheel 9, the segments 10 and the bottom 5 in order to brace the segments 10 with the bottom 5 and the drive wheel 9 and in this way provide a positive force connection. The housing 2 with the drive wheel 9, the segments 10 and the side covers 12, 12', as will be explained in detail below, together form the stator of the segment vane actuator 1.

Figure 2:
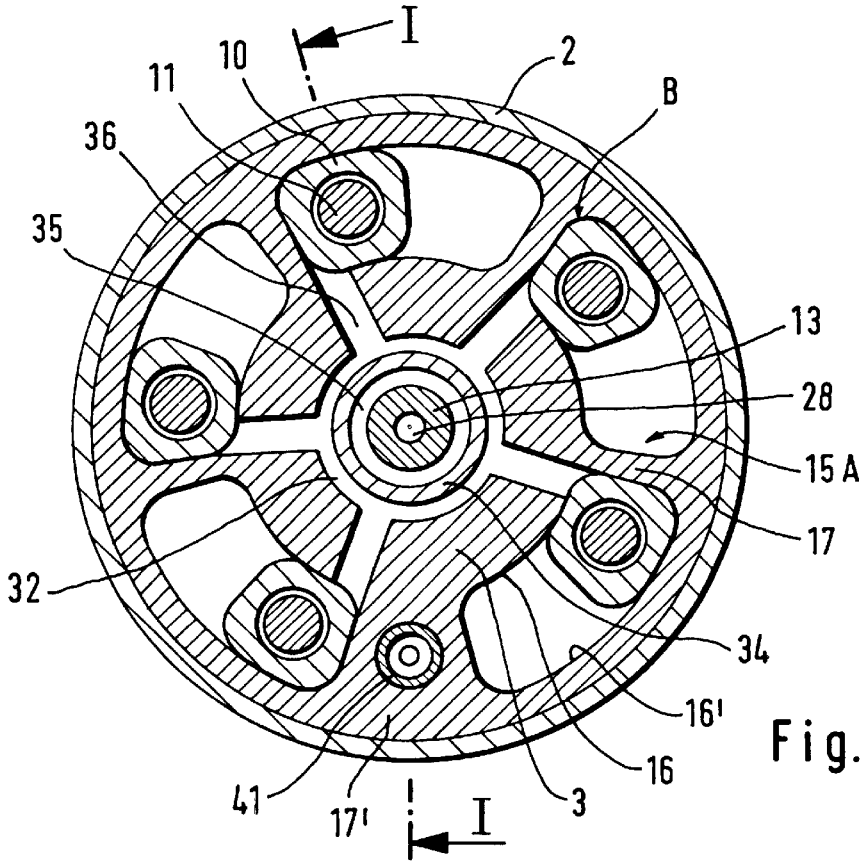
FIG. 2 is a cross sectional view through the rotor of the segment vane actuator along section plane B—B of FIG. 1.

The rotor 3 is connected in a non-rotatable manner, with the aid of a central clamping screw 13 through a seal ring carrier 14 with camshaft 4. The rotor 3 has in its peripheral area five hydraulic chambers 15, as shown in FIG. 2, constructed as axially extending, concentric oblong holes with curved walls 16, 16' separated from one another by radially extending bars 17, 17'. The hydraulic chambers 15 are penetrated by the segments 10 and subdivided sealingly into two active oil chambers A and B in each case.

The segments 10 have an approximately trapezoidal outer contour with two sides adapted to the shape of the radially standing bars 17, 17' and two sides adapted to the curved walls 16, 16'. Due to the enlarged seal length of the segments against the circular cross section, leakage between active oil chambers A and B is diminished.

The hydraulic chambers 15 are sealed off laterally by the side covers 12, 12' mentioned above with seal play. These are installed in coaxial, cylindrical recesses 18 on both sides of the rotor 3. The axial position of the side covers 12, 12', and in this way their close play in relation to the rotor 3, are fixed through retaining rings 19 which are arranged in the cylindrical part of the recesses 18 in grooves. The side covers 12, 12' have aligned apertures 20 with the cross section shape of the segments 10 through which these extend with close play. As parts of the stator, the side covers 12, 12' are non-rotatable in relation to the segments 10 and are rotatable in relation to the rotor 3.

The length of the segments 10 exceeds the greatest width of the rotor 3 by more than the stroke length of the camshaft 4 in order to guarantee the same free space necessary for axial actuation. The extended segments 10 serve the rotor 3 during axial displacement as guide rods on which this glides with the small radial play of the segments 10 in their hydraulic chambers 15. In order to avoid a redundant determination of the mounting of the drive wheel 9, the radial play between the drive wheel 9 and the seal ring carrier 14 as well as between the cylindrical housing 2 and the rotor must be greater than the radial play between segments 10 and the curved walls 16, 16' of the hydraulic chambers 15. Radial forces of the drive wheel 9 are consequently not directly transmitted over the segments 10 and the rotor 3 to the sealing ring bearer 14. On the periphery of the rotor 3, for bridging the radial play in relation to the cylindrical housing 2, a sealing ring 21 is arranged, through which the same is subdivided into a first and second operating chamber 22, 23. For damping the striking noise of the rotor 3 on the bottom 5, an elastic buffer 33 is arranged on the latter.

The pressurized oil supply to the operating chambers 22, 23 takes place through a first 4/3 way proportional valve 24. This takes place through a from connection with a first and a fourth radial groove 25, 26 of the sealing ring carrier 14. The first radial groove 25 is connected via four axial bore holes 27 evenly distributed through the sealing ring carrier 14 with the first operating ring chamber 22. The fourth radial groove 26 is connected via a central bore hole 28 in the clamping screw 13 with the second operating chamber 23.

The pressurized oil supply to the active oil chambers A and B takes place through a second 4/3 way proportional valve 29. This takes place through a flow connection with second and third radial grooves 30, 31 of the seal ring carrier 14. The second radial groove 30 is connected through an outer annular space 32 between a central recess of the seal ring carrier 14 and a sheath 34 as well as over (not represented) radial bore holes in rotor 3 with the active oil chambers A. The third radial groove 31 is connected via an inner annular space 35 between the sheath 34 and the clamping screw 13 and through radial bore holes 36 in the rotor with the active oil chambers B.

The proportional valves 24, 29 are controlled by a decentralized control apparatus 37. This receives signals from a camshaft sensor 38 on the phase and stroke position of the camshaft 4, and from a central control apparatus 39, which signals on motor speed, load and temperature. The two control apparatuses 37, 39 are connected with each other through a data bus. Since the proportional valves 24,29 are activatable independently of each other, phase and stroke relationship of the camshafts 4 can be varied independently of each other.

Between radial grooves 25, 26, 30, 31 of the seal ring carrier 14 and outside of the same, oil sealing rings 40 are provided which bring about a short overall length and low leakage for this rotary transmission through passage.

For locking of the rotor 3 on starting, an axial fixing pin 41 is provided which is latchable into a blind aperture 42 of the side cover 12' with spring force when the internal combustion engine is coasting, and can snap out again when a minimum oil pressure is exceeded in active oil chambers A and B.

Figure 3:
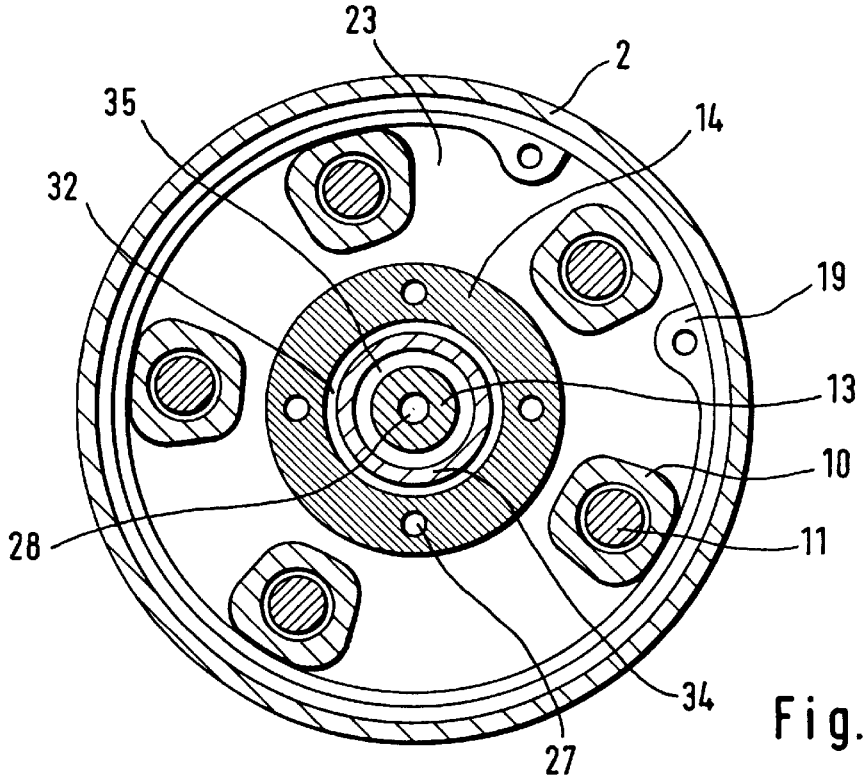
FIG. 3 is a cross sectional view through an operating chamber of the segment wing vane along section plane C—C of FIG. 1.

In FIG. 3, the segments 10 operating in the region of the section plane C—C as guide rods are represented. Likewise, the retaining ring 19 for the side cover 12' is shown. Also the clamping screw 13 with its central bore hole 28, the sheath 34 with the outer and inner annular space 32, 35 and the sealing ring carrier 14 with the four axial bore holes 27 are represented.

Figure 4:
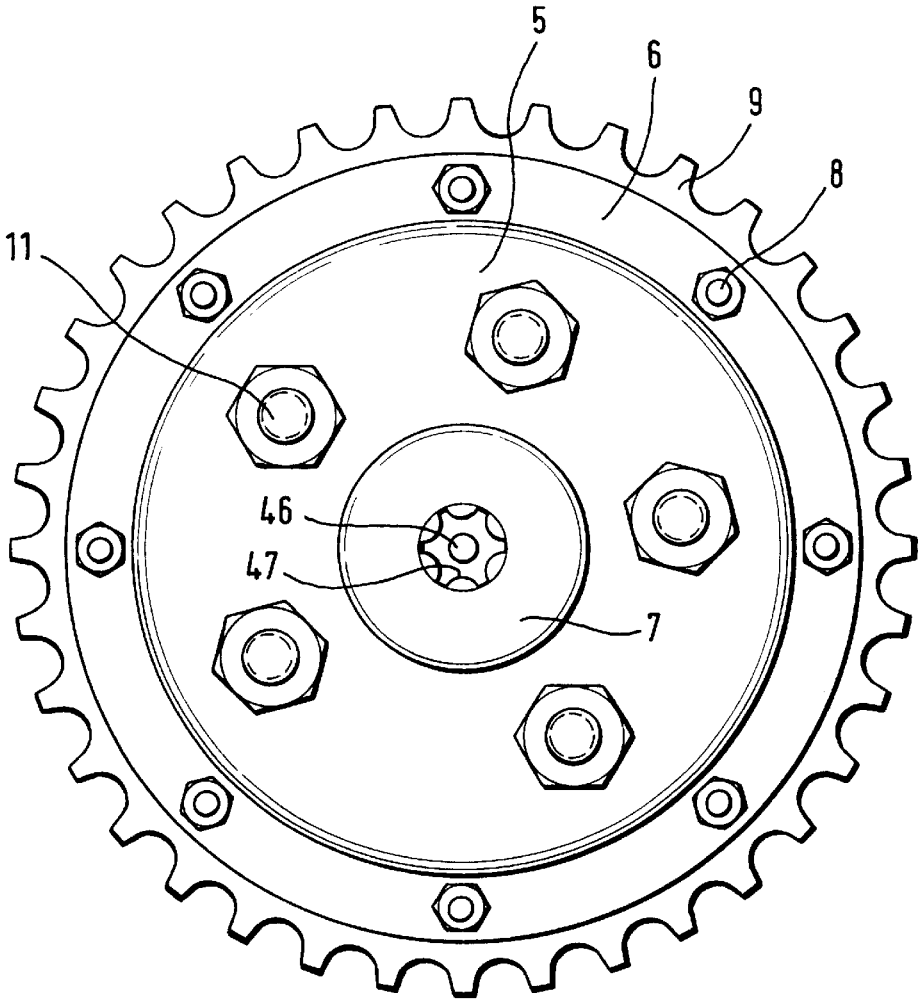
FIG. 4 is an elevational view of the housing in direction Z of FIG. 1.

FIG. 4 shows the drive wheel 9 with the flange screws 8 and the bottom 5 with the through bolts 11 as well as the screw cap 7 with the hexagon 47 and the bearing pin 46.

The actuating device of the invention can obviously not only be used in connection with intake valves but also in connection with outlet valves or in connection with both camshafts at the same time. It is also conceivable that the actuating device is bringable into a base position by suitable springs in the emptied state.

Reference Number List

| | | | |
|---|---|---|---|
| 1 | Segment vane actuator | 24 | First 4/3 way proportional valve |
| 2 | Housing | 25 | First radial groove |
| 3 | Rotor | 26 | Fourth radial groove |
| 4 | Camshaft | 27 | Axial bore hole |
| 5 | Bottom | 28 | Central bore hole |
| 6 | Flange | 29 | Second 4/3 way proportional valve |
| 7 | Screw cap | 30 | Second radial groove |
| 8 | Flange screw | 31 | Third radial groove |
| 9 | Drive wheel | 32 | Outer annular space |
| 10 | Segment | 33 | Buffer |
| 11 | Through bolt | 34 | Sheath |
| 12,12' | Side cover | 35 | Inner annular space |
| 13 | Clamping screw | 36 | Radial bore hole |
| 14 | Seal ring carrier | 37 | Decentralized control apparatus |
| 15 | Hydraulic chamber | 38 | Camshaft sensor |
| 16,16' | Curved wall | 39 | Central control apparatus |
| 17,17' | Bar | 40 | Oil sealing ring |
| 18 | Recess | 41 | Axial fixation pin |
| 19 | Retaining ring | 42 | Blind aperture |
| 20 | Aperture | 43 | Face |
| 21 | Sealing ring | 44 | Bearing bushing |
| 22 | First operating chamber | 45 | Outer surface |
| 23 | Second operating chamber | 46 | Bearing pin |
| | | 47 | Hexagon |

What is claimed is:

1. Device for independent actuation of phase and axial position of a camshaft of an internal combustion engine, comprising a phase adjuster constructed as a rotating piston actuator having a stator and a rotor, and an actuating piston arranged on a common axis for axial displacement of the camshaft as well as a cylindrical housing for the actuating piston, the housing is connected with the stator and a drive wheel of the stator, and the rotor and the actuating piston are connected in a rotatably fixed manner to the camshaft, and the phase adjuster forms the actuating piston for the camshaft (4), wherein the phase adjuster is constructed as a segment vane actuator (1) which has a cylindrical rotor (3) having a peripheral area in which at least one axial, concentric hydraulic chamber (15) constructed as an oblong hole is provided, which is subdivided by a segment (10) with close play into active oil chambers (A, B) and is laterally closed off by two side covers (12, 12') with close play, and the side covers (12, 12') have aligned apertures (20) having a complementary cross section shape to the segment (10), through which the segment extends with close play.

2. Device according to claim 1, wherein a length of the segments (10) exceeds a greatest width of the rotor (3) at least by a stroke length of the camshaft (4), and in that the segments (10) are constructed hollow and are connected via fasteners which extend through a bottom (5) of the housing (2), the hollow segments and a cover plate constructed as the drive wheel (9).

3. Device according to claim 2, wherein the rotor (3) has on both sides coaxial cylindrical recesses (18) for the side covers (12, 12'), and the side covers are axially fixed by retaining rings (19).

4. Device according to claim 3, wherein on a periphery of the rotor (3), at least one sealing element (21) is arranged through which the cylindrical housing (2) is subdivided into a first and second operating chamber (22, 23).

5. Device according to claim 4, wherein a first and second 4/3 way proportional valves (24, 29) are provided for independent hydraulic control of the active oil chambers (A, B) and the first and second operating chambers (22, 23).

6. Device according to claim 5, wherein a decentralized control apparatus (37) is provided for the proportional valves (24, 29) which receives signals on phase and stroke position of the camshaft (4) from a camshaft sensor (38) and signals on at least one of motor speed, motor load and motor temperature from a central control apparatus (39) of the internal combustion engine.

7. Device according to claim 6, wherein a seal ring carrier (14) of an rotary oil through passage device is located between rotor (3) and camshaft (4) which has oil sealing rings (40) for mutual and outward-acting sealing of radial grooves (25, 26, 30, 31) of oil supply channels.

8. Device according to claim 7, wherein radial forces of the drive wheel (9) are transmittable over the segments (10) and the rotor (3) to the seal ring carrier (14) and the shaft (4).

9. Device according to claim 8, wherein the rotor (3) includes a locking element comprised of an axial fixing pin (41) which is snappable into a blind aperture (42) in one of side covers (12, 12').

* * * * *